US007992246B2

(12) United States Patent
Takeuchi et al.

(10) Patent No.: US 7,992,246 B2
(45) Date of Patent: Aug. 9, 2011

(54) RADIAL VANE FOR TOOTH BRUSH, TOOTH BRUSH USING THE SAME, AND METHOD AND DEVICE FOR MANUFACTURING THE RADIAL VANE FOR THE TOOTH BRUSH

(75) Inventors: Toshifumi Takeuchi, Higashiosaka (JP); Izumi Higuchi, Higashiosaka (JP); Yasushi Ueba, Higashiosaka (JP)

(73) Assignees: Higuchi Manufactory Co., Ltd., Higashiosaka-shi (JP); Tiger Kasei S.A., Higashiosaka-shi (JP)

( * ) Notice: Subject to any disclaimer, the term of this patent is extended or adjusted under 35 U.S.C. 154(b) by 1272 days.

(21) Appl. No.: 10/567,922

(22) PCT Filed: Jan. 27, 2005

(86) PCT No.: PCT/JP2005/001101

§ 371 (c)(1),
(2), (4) Date: Aug. 21, 2006

(87) PCT Pub. No.: WO2005/070254

PCT Pub. Date: Aug. 4, 2005

(65) Prior Publication Data

US 2007/0277338 A1 Dec. 6, 2007

(30) Foreign Application Priority Data

Jan. 27, 2004 (JP) ..... 2004-052452
Mar. 9, 2004 (JP) ..... 2004-001828
Jul. 5, 2004 (JP) ..... 2004-227339

(51) Int. Cl.
*A46B 9/04* (2006.01)

(52) U.S. Cl. ..... 15/167.1; 15/22.1

(58) Field of Classification Search ..... 15/167.1, 15/167.2, 167.3, 22.1, 23, 24
See application file for complete search history.

(56) References Cited

U.S. PATENT DOCUMENTS 3,258,802 A * 7/1966 Rodriguez ..... 15/23
5,035,020 A * 7/1991 Winiewski ..... 15/23
6,325,626 B1 * 12/2001 Blass ..... 433/141
6,471,300 B1 * 10/2002 Tomiyama ..... 300/21
6,477,729 B1 * 11/2002 Ben-Ari ..... 15/27

FOREIGN PATENT DOCUMENTS

| | | |
|---|---|---|
| JP | 10-337295 | 12/1998 |
| JP | 2003-88424 | 3/2003 |
| JP | 2003-219911 | 8/2003 |
| JP | 2003-319834 | 11/2003 |
| JP | 3646118 | 5/2005 |
| WO | 02/07563 | 1/2002 |

* cited by examiner

*Primary Examiner* — Dung Van Nguyen
(74) *Attorney, Agent, or Firm* — Oblon, Spivak, McClelland, Maier & Neustadt, L.L.P.

(57) ABSTRACT

In a 360-degree toothbrush in which a brush head is formed by superposing disk-shaped radial vanes 1 in an axial direction, the arranging pitch of the radial vanes 1 is increased so as to make the bristle density appropriate. Spacers are not used between the radial vanes 1 so as to increase the productivity, and to improve the hygiene condition. In order to realize these aspects, an annular protrusion or protrusions 3 are formed on one or both of the surfaces of an annular weld portion 2 of the radial vane 1. The annular protrusion 3 is formed at the same time when forming the weld portion 2 in a welding step in which the bristle bundle is opened radially and the center part is welded so that the radial vane 1 is manufactured.

5 Claims, 14 Drawing Sheets

RADIAL VANE FOR TOOTH BRUSH, TOOTH BRUSH USING THE SAME, AND METHOD AND DEVICE FOR MANUFACTURING THE RADIAL VANE FOR THE TOOTH BRUSH

TECHNICAL FIELD

The present invention relates to a radial vane in a disk-shape used for a toothbrush, a 360-degree toothbrush having a cylindrical radial head in which the vanes are used in the brush head, and a method and an apparatus for manufacturing the radial vane for the toothbrush.

BACKGROUND ART

A 360-degree toothbrush as described in Patent Document 1 has been known as a kind of a toothbrush. This toothbrush has a cylindrical radial brush head at the tip portion of the brush handle, and such a brush head can be manufactured by using a method, for example, described in Patent Document 2.

Patent Document 1: Japanese Patent Application Laid-Open No. H9-168427

Patent Document 2: Japanese Patent Application Laid-Open No. 2003-220080

By the method described in Patent Document 2, a disk-shaped radial vane, in which a plurality of bristle members extend outward from the center part in the radial direction of the disk shape, is manufactured, and the vanes are mounted to the tip portion of the brush handle sequentially so as to be superposed, whereby a cylindrical radial brush head is manufactured. The following explains the method of manufacturing a radial vane described in Patent Document 2 with reference to FIGS. 19 to 23.

As shown in FIG. 19, a manufacturing apparatus includes a bristle opening jig d disposed on a processing bed b, a bristle presser e, a welding head f, and a press-cutting punch g. The processing bed d has a through hole through which a bristle bundle a formed by bundling bristle members of a predetermined number penetrate, and has a bristle lifting chuck c disposed thereunder. The bristle opening jig d is combined with the annular-shaped bristle presser e concentrically. The bristle opening jig d and the bristle presser e, the welding head f, and the press-cutting punch g are selectively conveyed to a position right above the through hole of the processing bed b by a driving mechanism that is not shown in the drawings.

In operation, as a first step, the bristle bundle a penetrating the through hole of the processing bed b is pushed up from the under side by the bristle lifting chuck c provided below the processing bed b, and so as to be exposed on the processing bed b by a predetermined length.

In a second step, as shown in FIG. 20, the bristle opening jig d, the lower end face of which is formed conically, is pressed to the center part of the exposed part of the bristle bundle a, thereby opening the exposed part to the periphery. In a third step, as shown in FIG. 21, the annular-shaped bristle presser e combined to the outside of the bristle opening jig d is lowered so as to be pressed against the bristle members which are half-way opened, thereby completely opening the exposed part of the bristle bundle a to the periphery.

In a fourth step, as shown in FIG. 22, with the exposed part of the bristle bundle a being opened radially with the bristle presser e, the bristle opening jig d is lifted and evacuated to a side. Instead, the welding head f is moved to a position right above the through hole and is lowered so as to weld the center part of the bristle members, opened radially, in an annular shape. Finally, in a fifth step, as shown in FIG. 23, the welding head f is lifted and evacuated to a side, and instead, the press-cutting punch g is moved to a position right above the through hole and lowered, thereby separating and removing the inner side of the annular-shaped weld portion.

In this way, the disk-shaped radial vane is manufactured. The manufactured radial vane has a through hole, in the center part thereof, through which the tip portion of a brush handle penetrates, an annular-shaped weld portion provided around the through hole, and further, a plurality of bristle members extending outward from the weld portion in a radial direction (brush portion). A plurality of vanes are fitted and fixed to the tip portion of the brush handle so as to be superposed, whereby a 360-degree toothbrush having a cylindrical radial brush head at the handle tip portion is manufactured.

A 360-degree toothbrush manufactured in this way has no directionality in the peripheral direction of the brush handle, and has a characteristic that it is easy even for elderly persons or children to use this toothbrush. Further, it is very suitable for massaging gums or removing coat of tongue. On the other hand of such characteristics, there are also the following problems.

In the brush head formed by superposing a plurality of radial vanes manufactured by the method described in Patent Document 2, the bristle density becomes too high, especially in the axial direction, and this causes, in addition to the unpleasant sense of use, hurting gums, mucous membrane of mouth and enamel. Moreover, since the radial vanes are too close, there are such problems that the air permeability is deteriorated, which is not desirable in the hygiene point of view, and that it is hard for the tips of the bristles to be inserted between teeth.

In order to solve these problems, small annular-shaped spacers have been employed to be fitted between the radial vanes alternatively when superposing the vanes, thereby reducing the bristle density in the axial direction on purpose. However, a rise in cost due to increases of the number of components and of assembling works by using the spacers has been noted as a problem of great importance. In addition, there has also been a problem that the deterioration in hygiene is caused because of contamination of foreign materials when inserting the spacers and an increase in clearances due to spacers provided between the vanes.

Further, there is another problem of complication since it is necessary to use a plurality of tools appropriately in order to complete a radial vane. That is, independent steps using different tools are required, such as pressing and opening of the bristle bundle a by the bristle opening jig d, fixing by the bristle presser e, welding by the welding head f, and removing of the center part by the press-cutting punch g, and there are a large number of steps involved. This has prevented the productivity from increasing, and thus caused a problem that the price of a product becomes expensive.

DISCLOSURE OF THE INVENTION

Problems to be Solved by the Invention

An object of the present invention is to provide a radial vane for a toothbrush in which the bristle density in the axial direction is easily lowered and adjustable, a method and apparatus for manufacturing the radial vane, and a high-performance and economic 360-degree toothbrush in which the radial vanes are used.

Another object of the present invention is to provide a method and apparatus for manufacturing a radial vane for a toothbrush in which the number of manufacturing steps is small and the toothbrush price can be reduced significantly.

Means for Solving the Problems

A radial vane for a toothbrush of the present invention is in a disk-shape having a through hole at a center part thereof, through which a tip portion of a handle of the toothbrush penetrates; a weld portion in an annular shape provided around the through hole; and a plurality of bristle members extending from the weld portion outward in a radial direction of the disk shape. The weld portion includes a protrusion integrally formed on one or both of surfaces thereof.

In the radial vane for a toothbrush of the present invention, the weld portion includes a protrusion integrally formed on one or both of surfaces thereof, whereby clearances ate defined in the radial brush portion when the radial vanes are mounted so as to be superposed at the tip of the brush handle. Thus, the bristle density in the axial direction is lowered without using spacers, and the function of the toothbrush is improved. By changing the height of the protrusion, the width of a clearance is adjustable arbitrarily.

The protrusion may be an annular protrusion continuing in a circumferential direction, or a group of protrusions formed interspatially along a circumferential direction.

In the brush portion where the plural bristle members extend outward from the annular weld portion in the radial direction of the disk shape, long bristle members and short bristle members may be mixed. Further, bristle members having a large diameter and bristle members having a small diameter may be mixed. Moreover, by combining the both, it is possible to make the bristle members of a large bristle diameter long and to make the bristle members of a small bristle diameter short. By this, the hardness and the touch of the brush head and the brushing property can be widely adjustable.

A 360-degree toothbrush of the present invention is such that a radial brush head in a cylindrical shape, constituted by superposing a plurality of radial vanes according to the present invention is disposed at a tip portion of a handle of the toothbrush.

In the 360-degree toothbrush of the present invention, a cylindrical brush head is formed by superposing radial vanes in which a protrusion is formed integrally on the surface of the weld portion. Thus, the arranging pitch of the radial vanes in the brush head increases. Accordingly, the bristle density is lowered without using spacers, and the performance of the toothbrush is improved.

The radial brush head may have such a configuration that a hard radial vane having bristles of a large diameter and a soft annular vane having bristles of a small diameter mixed. Further, the brush head may have such a configuration that a radial vane of a large diameter having a long bristle length at a brush portion and a radial vane of a small diameter having a short bristle length at the brush portion mixed. Further, by combining the both, hard radial vanes of a large diameter and soft radial vane of a small diameter maybe mixed. With these configurations, the hardness and the touch of the brush head and the brushing property are widely adjustable. Further, this makes the bristle tips easily enter between the teeth.

A method of manufacturing a radial vane for a toothbrush of the present invention includes: a feeding step in which a bristle bundle formed by bundling a plurality of bristle members is caused to penetrate from the back face side to the surface side of a processing bed and exposed on the processing bed by a predetermined length; an opening step in which the exposed part of the bristle bundle is opened radially on the surface of the processing bed to the periphery; a welding step in which the center part of the bristle bundle opened radially is welded in an annular shape; and a removing step in which the inside of the annular weld portion is removed. In the welding step, when the center of the bristle bundle opened radially is welded, a protrusion is formed on the surface of the weld portion at the same time.

In the method of manufacturing the radial vane for a toothbrush of the present invention, the center part of the bristle bundle exposed on the processing bed and opened radially is welded in an annular shape, and a protrusion is formed on the surface of the weld portion at the same time. Therefore, it is possible to manufacture a radial vane having a protrusion on the weld portion efficiently and economically.

Further, another method of manufacturing the radial vane for a toothbrush includes: a feeding step in which a bristle bundle formed by bundling a plurality of bristle members are caused to penetrate from the back face side to the surface side of a processing bed and exposed on the processing bed by a predetermined length; an opening step in which the exposed part of the bristle bundle is opened radially on the surface of the processing bed to the periphery; and a welding and removing step in which the center part of the bristle bundle opened radially is pressed against the processing bed by a cylindrical welding head also serving as a punch so as to be welded in an annular shape, and at the same time, the inside of the annular weld portion is removed.

In another method of manufacturing the radial vane for a toothbrush of the present invention, the center part of the bristle members exposed on the processing bed and opened radially is welded in an annular shape by the cylindrical welding head also serving as a punch, and at the same time, the inside of the weld portion is removed, so welding and removing is performed with one tool and in one step. Therefore, the radial vane is manufactured efficiently and economically in the reduced number of steps.

If an annular blade, for cutting the inside of the annular weld portion in cooperation with the inner peripheral part of the welding head, is provided around the through hole of the processing bed, removal of the inside of the weld portion can be performed securely and smoothly.

Further, if an annular recessed part or a plurality of recessed parts arranged interspacially in a peripheral direction, into which a melting material is flown when welding, are provided around the through hole of the processing bed, when the center part of the bristle bundle opened radially is welded in an annular shape, a protrusion is formed on the surface of the weld portion at the same time.

An apparatus for manufacturing the radial vane for a toothbrush of the present invention includes: a feeding means for causing a bristle bundle formed by bundling a plurality of bristle members to penetrate from the back face side to the surface side of a processing bed so as to be exposed on the processing bed by a predetermined length; an opening means for opening the exposed part of the bristle bundle radially on the surface of the processing bed to the periphery; a welding means for welding the center part of the bristle bundle opened radially in an annular shape; and a removing means for removing the inside of the weld portion in an annular shape. The apparatus has a recessed part formed in an annular shape or a plurality of recessed parts arranged interspacially in a peripheral direction provided around the through hole of the processing bed such that a melting material is flown therein when welding.

In the apparatus for manufacturing the radial vane for a toothbrush of the present invention, a recessed part formed in an annular shape or a plurality of recessed parts arranged interspacially in a peripheral direction are provided around the through hole of the processing bed such that a melting material is flown therein when welding. Therefore, it is possible to form a protrusion on the surface of the weld portion at the same time as welding the center part of the bristle bundle, opened radially, in an annular shape.

Another apparatus for manufacturing the radial vane for a toothbrush of the present invention includes: a feeding means for causing a bristle bundle formed by bundling a plurality of bristle members to penetrate from the back face side to the surface side of a processing and exposing it on the processing bed by a predetermined length; an opening means for opening the exposed part of the bristle bundle radially on the surface of the processing bed to the periphery; and welding and removing means for pressing the center part of the bristle bundle opened radially against the processing bed by a cylindrical welding head also serving as a punch and welding it in an annular shape, and at the same time, removing the inside of the weld portion in an annular shape.

In another apparatus for manufacturing the radial vane for a toothbrush of the present invention, welding in an annular shape and removal of the inside of the weld portion are performed simultaneously with one tool and in one step by the cylindrical welding head also serving as a punch. Therefore, the radial vane is manufactured efficiently and economically with the reduced number of steps.

Here, it is preferable that the welding head be so configured as to include an exhaust hole for exhausting air at the center part thereof, to be capable of moving up and down, and with the exhaust air, to press the bristle bundle, opened to the periphery, against the processing bed so as to fix it radially. With this configuration, the welding head can also serve as an opening means, so the manufacturing steps can be rationalized further.

If an annular blade for removing the inside of the annular weld portion in cooperation with the punch is provided around the through hole of the processing bed, removal of the inside of the weld portion can be performed more securely and smoothly.

If an annular recessed part or a plurality of recessed parts arranged interspacially in a peripheral direction are provided around the through hole of the processing bed such that a melting material is flown therein when welding, a protrusion serving as a spacer can be formed on the surface of the weld portion at the same time as welding.

Effects of the Invention

The radial vane for a toothbrush of the present invention adopts a configuration that a protrusion or protrusions are formed integrally on one surface or on the both surfaces of the annular weld portion connecting a plurality of bristle members extending radially. Therefore, the bristle density in the axial direction in the brush head can be reduced. Thus, the sense of use of the toothbrush is improved, and further, there is no possibility of hurting gums, mucous membrane of mouth and enamel. Further, the bristle tips are inserted between teeth easily, and the brushing performance is also improved. Moreover, since there is no need to use spacers, the productivity becomes high, the economic efficiency becomes excellent, and the hygiene condition is further improved.

A 360-degree toothbrush of the present invention has a cylindrical radial brush head formed by superposing the plural radial vanes, at the tip portion of the brush handle. Thus, a proper bristle density is secured, so the sense of use is fine. Further, there is no possibility of hurting gums, mucous membrane of mouth and enamel. Further, the air permeability in the brush head is improved, so the hygiene condition is improved. Moreover, the bristle tips are inserted between teeth easily, so an excellent brushing performance is exhibited. Further, since a proper bristle density can be secured without using spacers, the productivity becomes high, the economic efficiency becomes excellent, and the hygiene condition becomes also excellent.

In the method of manufacturing the radial vane for a toothbrush of the present invention, the center part of the bristle bundle exposed on the processing bed and opened radially is welded in an annular shape, and at the same time, a protrusion is formed simultaneously on the surface of the weld portion. Therefore, it is possible to manufacture a radial vane having a protrusion on the weld portion efficiently and economically. Thus, a high-quality 360-degree toothbrush can be provided at low price.

In the other method of manufacturing a radial vane for a toothbrush of the present invention, the center part of the bristle bundle exposed on the processing bed and opened radially is welded in an annular shape by a cylindrical welding head also serving as a punch, and at the same time, the inside of the weld portion is removed, so welding and removing are performed with one tool and in one step. Therefore, the radial vane can be manufactured efficiently and economically with the reduced number of steps. Thus, the manufacturing cost of a 360-degree toothbrush can be reduced sufficiently.

The apparatus for manufacturing the radial vane for a toothbrush of the present invention has a recessed part formed in an annular shape or a plurality of recessed parts arranged interspacially in a peripheral direction provided around the through hole of the processing bed such that a melting material is flown therein when melting. Therefore, at the same time as welding the center part of the bristle bundle opened radially in an annular shape, a protrusion can be formed on the surface of the weld portion, so a radial vane having a protrusion on the weld portion can be manufactured at low cost. Thus, a high-quality 360-degree toothbrush can be provided at low price.

In the other apparatus for manufacturing the radial vane for a toothbrush of the present invention, welding and removal of the inside of the weld portion are performed simultaneously with one tool and in one step by the cylindrical welding head also serving as a punch. Therefore, the radial vane can be manufactured efficiently and economically with the reduced number of steps. Thus, the manufacturing cost of a 360-degree toothbrush can be reduced sufficiently.

BEST MODE FOR CARRYING OUT THE INVENTION

Hereinafter, an embodiment of the present invention will be explained based on the drawings. FIG. 1 is an external view of a 360-degree toothbrush showing an embodiment of the present invention. FIG. 2 shows a front view of a radial vane used in the 360-degree toothbrush, and a sectional view taken along the line A-A. FIGS. 3 to 5 are explanatory drawings of a manufacturing method and a manufacturing apparatus for the radial vane. FIGS. 6 to 8 are explanatory drawings of a manufacturing method for a 360-degree toothbrush using the radial vane.

In the present embodiment, a 360-degree toothbrush has a cylindrical brush head at the tip portion of a brush handle 14, as shown in FIG. 1. The cylindrical brush head is composed by superposing, in the cental axial direction, a predetermined number of disk-shaped radial vanes 1 formed by processing bristle members made of nylon resin used for a toothbrush.

As shown in FIG. 2, the radial vane 1 has a through hole in the center part, through which the tip portion of the brush handle 14 penetrates. Around the through hole, a weld portion 2 consisting of an annular disk is provided, and a plurality of bristle members extends radially from the weld portion 2 so as to form an annular-shaped brush. On one surface of the weld portion 2, an annular protrusion 3 having a half-round cross-section is formed integrally along the whole periphery.

Such a radial vane 1 is manufactured as follows. As shown in FIG. 3, a manufacturing apparatus manufactures the radial vane 1 from a bristle bundle 4 configured by bundling bristle members 4A made of nylon resin. For this manufacturing, the manufacturing apparatus includes a processing bed 6 and a cylindrical welding head 5 provided above the processing bed 6. The processing bed 6 has a through hole through which the bristle bundle 4 passes, and has push-up chucks 7 and 8 for pushing up the bristle bundle 4 under the processing bed 6.

On the surface of the processing bed 6, an annular blade 6B is provided contacting the through hole. The annular blade 6B becomes higher from the outer peripheral side to the inner peripheral side, and the inner peripheral face continues to the inner peripheral face of the through hole. In the outer peripheral side of the annular blade 6B, an annular recessed part 6C is formed contacting the annular blade 6B. The annular recessed part 6C is for forming an annular protrusion 3 of the radial vane 1, and has a half-round cross-section corresponding to the cross-section of the annular protrusion 3. In the outer peripheral side of the annular recessed part 6C, another annular recessed part 6A is provided with a small space therebetween. The annular recessed part 6A is used for cutting so as to trim the outer radius of the radial vane 1.

The cylindrical welding head 5 is disposed concentrically above the through hole of the processing bed 6, and is driven up and down by a driving mechanism not shown. The welding head 5 is a welding horn performing welding with supersonic vibration, which is driven by a vibrator not shown. A through hole provided in the center part of the welding head 5 is an air hole 5A used to open the bristle bundle 4 to the periphery. The tip portion of the welding head 5 also serves as a heat-cutting punch, in which the air hole 5A is enlarged such that an inner peripheral part 5B forms a blade part in combination with the blade part 6B of the processing bed 6. An annular tip face 5C of the welding head 5 is a welding face.

In operation, the bristle bundle 4 is inserted into and penetrates the through hole of the processing bed 6 from the lower side (back face side) to the upper side (surface side), and with a push-up by the push-up chuck 7 provided under the processing bed 6, the bristle bundle 4 is exposed by a predetermined amount on the processing bed 6. The exposed amount is set to be larger than the radius of the radial vane 1. When the bristle bundle 4 is exposed with the predetermined amount on the processing bed 6, the welding head 5 is lowered while blowing the air and vibrating. The blown air from the welding head 5 collides with the center part of the exposed part of the bristle bundle 4 thereunder. Thus, the exposed part of the bristle bundle 4 is opened evenly to the periphery. In this state, the welding head 5 keeps descending so as to press the bristle bundle 4, opened to the periphery, against the processing bed 6. Thus, the exposed part of the bristle bundle 4 is opened completely to the periphery so as to be in a radial state. The vibration of the welding head 5 contributes to the exposed part of the bristle bundle 4 being opened to the periphery evenly and smoothly.

When the opening of the bristle bundle 4 by the welding head 5 has been completed, the opened bristle bundle 4 is fixed with an annular bristle presser 9, as shown in FIG. 4. The bristle presser 9 is disposed concentrically above the processing bed 6 so as to surround the welding head 5, and is driven up and down independently from the welding head 5. The lower face of the bristle presser 9 is a Teflon (registered trademark) coated face 9A for opening the bristle bundle 4 beautifully, the coefficient of friction of which is reduced. On the outer peripheral side of the bristle presser 9, an annular cutting blade 10 is provided. The cutting blade 10 corresponds to the annular recessed part 6A provided in the surface of the processing bed 6. Therefore, when the bristle presser 9 descends, the bristle bundle 4 is fixed radially, and at the same time, the radial bristle bundle 4 is cut by the cutting blade 10 to have a predetermined outer diameter.

In parallel with the cutting of the outer diameter of the bristle bundle 4 opened radially, the welding head 5 presses the center part of the bristle bundle 4 opened radially, and the annular welding face 5C at the tip thereof welds the center part in an annular shape. While performing the welding, the inner peripheral part 5B of the welding head 5 is pressed toward the blade part 6B of the processing bed 6, whereby the inner side of the weld portion 2 is heat-cut in an annular shape, and the inside thereof is removed. Here, since the main component of the bristle member is nylon resin, a part of the melting material flows into the recessed part 6C formed in the surface of the processing bed 6 simultaneously with the welding, and the annular protrusion 3 having a half-round cross-section is formed integrally on one surface of the weld portion 2.

In the present embodiment, the radial vane 1 is manufactured rapidly from the bristle bundle 4 in this manner. Specifically, opening and fixing of the bristle bundle 4, cutting of the outer diameter, annular welding of the center part, and cutting of the inside of the weld portion are performed continuously at a fixed position. In particular, opening of the bristle bundle 4, annular welding of the center part, and removing of the inside of the weld portion are performed simultaneously by the welding head 5. Therefore, the radial vane 1 is manufactured with high efficiency from the bristle bundle 4.

The radial vane 1 manufactured on the processing bed 6 is separated from the bristle bundle 4 when the inside of the weld portion 2 is removed. The tip portion of the remaining bristle bundle 4 is adhered excessively by welding. When the welding head 5 and the bristle presser 9 are lifted to the original positions, the bristle bundle 4 is pushed up by 2 mm, for example, by another bristle push-up chuck 8 as shown in FIG. 5, and the excess weld portion 12 of the tip is removed by a cutter 11 in a horizontal direction. Thus, the tip portion of the bristle bundle 4 is separated, and manufacturing of the next radial vane is prepared. The excess weld portion 12, which has been cut, is sucked by an air blow 13 provided on a side. When the welding head 5 and the bristle presser 9 are lifted to the original positions, the radial vane 1 manufactured is also released and sucked by the air blow 13.

By repeating this procedure, the radial vanes 1 are manufactured continuously from the bristle bundles 4 with high efficiency. The radial vanes 1 manufactured are assembled into a 360-degree toothbrush in the following manner.

First, as shown in FIG. 6, a brush handle 14 is supported vertically with the tip portion being down. Then, to the vane supporting part of a small diameter formed at the tip portion of the brush handle 14, the manufactured radial vanes 1 of the predetermined number are fitted sequentially from the lower part. At this time, the radial vane 1 is held to have a posture where the annular protrusion 3 formed on the annular weld portion 2 faces downward. The fitting may be performed manually or by an automated machine not shown. In order to prevent the inserted radial vanes 1 from falling off during assembling, the diameter of a portion of about 3 mm length in the tip portion is processed to be larger by about 0.1 mm.

When the radial vanes 1 of the predetermined number are inserted to the tip portion of the brush handle 14, the brush handle 14 is conveyed to the next step with a conveyer. In this step, as shown in FIG. 7, the brush handle 14 is set facing downward on a welding machine 15, and the welding machine 15 is lifted by an air cylinder and is pressed against the tip face of the brush handle 14, whereby the proximity of the tip face is processed to be wider. In this way, a predetermined number of radial vanes 1 are fixed to the tip portion of the brush handle 14, whereby a cylindrical brush head is formed. The welding time is set appropriately with a timer, while considering the pressing speed, the pressure and the heating temperature, taking into account the room temperature and the like.

When the attachment of the radial vanes 1 has been completed, the brush handle 14 is conveyed to the next step by a conveyer. In this step, as shown in FIG. 8, the outer peripheral face of the completed brush head is processed by a bristle tip rounding processor 16. The bristle tip rounding processor 16 is so configured that a sand paper of No. 600 having the width of about 10 mm is attached to the surface of a sand paper of around No. 400 in a diagonal direction, which is fixed to the surface of a drum, and the drum is rotated by a driving motor 17. Then, the outer peripheral face of the brush head is made to contact the surface of the rotating processor 16, and in this state, the brush head is moved in the axial direction while being rotated. Thus, the respective bristle tips in the brush head are processed to be round. The tension of the paper part is adjusted appropriately while considering the material, the diameter and the like of the bristle member.

In the present embodiment, a 360-degree toothbrush is completed through the above-described steps. The characteristics of the completed 360-degree toothbrush are as follows.

On one surface of the disk-shaped weld portion 2 of the radial vane 1, the boss-shaped annular protrusion 3 is formed integrally. Thus, a predetermined space is secured between the brush portions of the adjacent radial vanes 1 by only piling up the radial vanes 1 in the same direction, without providing a spacer between the adjacent vanes. Therefore, in a cylindrical brush head, the bristle density in the axial direction can be reduced to an appropriate range. This improves the sense of use, and further, there is no possibility of hurting gums, mucous membrane of mouth and enamel. Further, air permeability is improved, whereby the hygienic state is improved. Further, advantages such as bristle tips being inserted between teeth easily and reaching the last molars easily are achieved.

Further, the annular protrusion 3 is formed at the same time as the forming of the weld portion 2, so extra cost is not required for forming. Therefore, this does not cause the manufacturing cost to increase.

The height of the boss part consisting of the annular protrusion 3 is preferably 0.1 to 0.4 mm. If the height is too low, the bristle density of the brush head in the axial direction is not reduced sufficiently. In contrast, if the height is too high, the bristle density becomes too dense, so a problem is caused in practice. Further, the boss part is formed with resin flown from the weld portion. If the boss part is too high, the formation is difficult from the point of securing the resin amount.

In assembling the cylindrical brush head, there is no need to use spacers. Therefore, an increase in the number of components can be prevented, and the manufacturing steps are rationalized significantly. Thus, the manufacturing cost can be reduced significantly. Further, contamination of foreign articles is prevented, and the hygienic state is further improved. The operation of penetrating the radial vanes 1 and spacers alternatively was very inefficient and the time loss was enormous. By only inserting the radial vanes 1, the assembling time is reduced in half, whereby mass production and significant reduction in the product price are realized.

In manufacturing the radial vane 1, supplying of the bristle bundle 4 to opening to a radial shape, fixing, welding of the center part, removal of the inside of the weld portion, and removal of the excess weld portion 12 of the bristle bundle 4 are performed continuously at a fixed position. In particular, opening of the bristle bundle 4, welding of the center part, and removal of the inside of the weld portion are performed by the welding head 5 with one tool and in one step. Therefore, the productivity of the radial vane 1 is improved and the manufacturing apparatus is inexpensive, so it is possible to reduce the manufacturing cost of the radial vane 1 substantially.

As described above, a high quality 360-degree toothbrush is manufactured economically, which is to be marketed at low price.

FIG. 9 is a cross-sectional view showing another example of a radial vane.

In this radial vane 1, the annular protrusions 3 and 3 are provided on both surfaces of the annular weld portion 2. As a method of forming the annular protrusions 3 and 3 on both faces of the weld portion 2, an annular recessed part corresponding to the annular recessed part 6C formed in the surface of the processing bed 6 is also formed in an annular tip weld face 5C of the welding head 5. Thus, the annular protrusions 3 and 3 are formed on the both faces at the same time as forming the weld portion 2.

In the cylindrical brush head formed by superposing the radial vanes 1, the annular protrusions 3 and 3 opposite each other between the adjacent radial vanes 1 and 1 are overlapped, whereby a spacer is formed, so the bristle density in the axial direction is reduced. In this case, the height of the annular protrusion 3 may be ½ of the case where the annular protrusion 3 is formed on one surface.

FIG. 10 is a front view showing another example of a radial vane.

In this radial vane 1, long bristle members and short bristle members are mixed. More specifically, a plurality of bristle members 40 extending radially from the annular weld portion 2 to the outer peripheral side has such a configuration that long bristle members 41 and short bristle members 42 are mixed. On the surface of the weld portion 2, a boss part consisting of the annular protrusion 3 is formed in the same manner as in another radial vane 1.

Such a radial vane 1 can be manufactured in the following manner for example. When the radial vane 1 is manufactured on the processing bed 6, the bristle bundle 4 is exposed by a predetermined length on the processing bed 6. At this time, about a half of the bristle members are exposed longer from the processing bed 6, and the remaining bristle members are exposed shorter from the processing bed 6. Then processing is performed to the bristle bundle 4 in which the both are mixed randomly. Thus, the radial vane 1, in which bristle members of different lengths are mixed in the brush portion where a plurality of bristle members extending radially, is manufactured.

When a brush head is formed of such radial vanes 1, the 360-degree toothbrush has such a characteristic that the bristle tips can reach between teeth and the rear side of the last molars, particularly.

FIG. 11 is a front view showing still another example of a radial vane.

In this radial vane 1, wide long bristle members and narrow short bristle members are mixed. More specifically, a plurality of bristle members 40 extending radially from the annular weld portion 2 to the outer peripheral side has such a configuration that wide long bristle members 43 and narrow short bristle members 44 are mixed. On the surface of the weld portion 2, a boss part consisting of an annular protrusion 3 is formed as same as another radial vane 1.

Such a radial vane 1 can be manufactured in the following manner for example. When the radial vane 1 is manufactured on the processing bed 6, the bristle bundle 4 is exposed by a predetermined length on the processing bed 6. At this time, one in which wide bristle members and narrow bristle members are mixed is used as the bristle bundle 4. The wide bristle members are exposed longer from the processing bed 6, and the narrow bristle members are exposed shorter from the processing bed 6. Then, processing is performed to the bristle bundle 4 in which the both are mixed randomly. Thus, the radial vane 1, in which bristle members of different lengths are mixed in the brush portion where a plurality of bristle members extending radially, is manufactured.

When a brush head is formed of such radial vanes 1, the 360-degree toothbrush has such a characteristic that the bristle tips can reach between teeth and the rear side of the last molars, particularly. Further, the toothbrush has excellent brushing property, realizes soft touching sense to the oral cavity or gums, and can achieve excellent massage effect. This is because, the long bristle members reaching between teeth and the rear side of the last molars are hard, and the short bristle members touching gums and oral cavity are soft. Further, since wide bristle members and narrow bristle members are used together, it is possible to adjust the brush hardness corresponding to the condition of oral cavity and gums.

FIG. 12 is a brush external view showing another example of a 360-degree toothbrush.

This 360-degree toothbrush has a brush head in which two kinds of radial vanes 1A and 1B are mixed. One radial vane 1A is a large diameter vane in which bristle members extending radially from the annular weld portion to the periphery are long, and the other one is a small diameter vane in which bristle members are short. By combining the radial vanes 1A of the large diameter and the radial vanes 1B of the small diameter alternatively, the brush head becomes one that bristle members of different lengths are mixed. Thus, the bristle tips can reach between teeth and the rear side of the last molars properly.

FIG. 13 is a brush external view showing another example of a 360-degree toothbrush.

This 360-degree toothbrush has a brush head in which two kinds of radial vanes 1C and 1D are mixed. One radial vane 1C is a hard vane using wide bristle members, and the other one is a soft vane using narrow bristle members. By combining the hard radial vanes 1C and the soft radial vanes 1D alternatively, the brush head becomes one that bristle members of different hardness are mixed. Thus, it is possible to adjust the brush hardness corresponding to the condition of oral cavity and gums. For example, when gums are weakened due to gingivitis, periodontic diseases or the like, the hardness adjustment corresponding thereto is possible.

FIG. 14 is a brush external view showing another example of a 360-degree toothbrush.

This 360-degree toothbrush has a brush head in which two kinds of radial vanes 1E and 1F are mixed. One radial vane 1E is a hard vane having a large diameter using wide and long bristle members, and the other one is a soft vane having a small diameter using narrow and short bristle members. By forming a brush head while combining them alternatively, the brush head becomes one that the bristle tips can reach between teeth and the rear side of the last molars properly, and excellent massage effect can be realized with respect to gums and oral cavity. This is because the long bristle members reaching between teeth and the rear side of the last molars are hard, and the short bristle members touching gums and oral cavity are soft. Further, since wide bristle members and narrow bristle members are used together, it is possible to adjust the brush hardness corresponding to the condition of oral cavity and gums.

FIG. 15 is a brush external view showing still another example of a 360-degree toothbrush.

In this 360-degree toothbrush, a cylindrical brush head configured by superposing the radial vanes 1 is formed in a taper shape in which the outer diameter is reduced progressively from the base end part toward the tip portion. Such a brush head can be formed in the last stage of cutting the outside face. With this brush head, brushing can be done accurately to the last molars, and it may be effective for pets by widening the diameter of the bristle member.

Here, the width of the bristle member and the vane diameter of the radial vane of the present invention will be explained. Typically, the width of a bristle member used in a general toothbrush is 0.15 to 0.2 mm. On the other hand, with a 360-degree toothbrush of the present invention, when brushing teeth with one side face of the brush head, mucous membrane of mouth is rubbed with the other side face. Therefore, a bristle member having a diameter of 0.08 to 0.14 mm, which is narrower than a bristle member used for a general toothbrush, is preferable as a bristle member of the radial vane of the present invention. More preferably, as a brush of a normal hardness, a bristle member having a diameter of 0.11 to 0.14 mm is suitable, and as a soft brush safe for gums and oral cavity, a bristle member having a diameter of 0.08 to 0.10 mm is suitable. The wide bristle member described above is the former, and the narrow bristle member is the latter.

As for the vane diameter, 15 to 18 mm is suitable from the viewpoints of sense of use and the brushing property, which is as same as the width of the head part of a general toothbrush. In the case of a brush head in which large diameter vanes having long bristle members in the brush portion and small diameter vanes having short bristle members in the brush portion are mixed, the diameter of the large diameter vane corresponds to the general diameter, and the diameter of the small diameter vane is suitably 0.8 to 0.95 times the diameter of the large diameter vane. If the diameter difference here is small, the significance of giving the diameter difference is reduced. If the diameter difference is too large, short bristle members will not reach gums. Even in the case where long bristle members and short bristle members are mixed in the brush portion of one radial vane, the bristle length difference conforming to the diameter difference is desirable.

FIGS. 16 to 18 show automatic manufacturing equipment for 360-degree toothbrushes, in which FIG. 16 shows a brush handle feeding device, FIG. 17 shows a manufacturing and laminating device for radial vanes, and FIG. 18 shows a fixing device for radial vanes, respectively.

The automatic manufacturing equipment for 360-degree toothbrushes includes the brush handle feeding device shown in FIG. 16, the manufacturing and laminating device for radial vanes shown in FIG. 17, and the fixing device for radial vanes shown in FIG. 18.

The brush handle feeding device (FIG. 16) has a feeding robot 21. The feeding robot 21 includes a rotational axis 22 vertical to a position eccentric from the revolution center. The rotational axis 22 is provided with a plurality of feeding arms 23 at the lower end part. The feeding robot 21 moves the plural feeding arms 23 to a brush feeding part 24 by the revolution movement, and after plural brush handles 14 are clamped simultaneously by the plural feeding arms 23, the feeding robot 21 is back to the manufacturing and laminating device for radial vanes. Then, the feeding robot 21 rotates the plural feeding arms 23, whereby the plural brush handles 14 are provided to the plural manufacturing and laminating device, respectively.

Each manufacturing and laminating device for radial vanes (FIG. 17) has a horizontal rotary table 25. The rotary table 25 is set on a bracket 26, and is rotationally driven by a driving body 27 provided below. On the surface of the rotary table 25, two processing beds 6 and 6 are mounted across the rotational center. With the rotation of the rotary table 25, the two processing beds 6 and 6 move circularly between a vane manufacturing position and a vane laminating position. At the vane manufacturing position, the welding head 5 and the lifting chuck 28 are provided sandwiching the rotary table 25, and at the vane laminating position, a handle clamp 29 is provided above the rotary table 25. The handle clamp 29 chucks and moves up and down the brush handle 14 provided from the brush handle feeding device with the tip portion being downward.

In operation, the radial vane 1 is manufactured from the bristle bundle 4 at the vane manufacturing position. The manufacturing method is substantially same as the method described above. After the bristle bundle 4 is exposed on the processing bed 6 by a predetermined length by the lifting chuck 28, the welding head 5 is lowered and the radial vane 1 with a boss is manufactured on the processing bed 6. When the radial vane 1 is manufactured on the processing bed 6 at the vane manufacturing position, the bristle bundle 4 penetrating the rotary table 25 and the processing bed 6 are drawn downward to a descending point shown by 4B. Then, the rotary table 25 rotates until the processing bed 6 moves to the vane laminating position. At this time, the manufactured radial vane 1 is kept on the processing bed 6, and the boss part (annular protrusion 3) formed on the lower face of the weld portion 2 contributes to fixing of positioning of the radial vane 1 and improvement in stability.

When the radial vane 1 is conveyed to the vane laminating position, the handle clamp 29 is lowered, and the tip portion of the brush handle 14 held by the handle clamp 29 is inserted into the radial vane 1 on the processing bed 6. When finished, the rotary table 25 rotates again, and the processing bed 6 is returned from the vane laminating position to the vane manufacturing position, and the radial vane 1 is conveyed from the vane manufacturing position to the vane laminating position. By repeating this step, the radial vanes 1 of the predetermined number are fitted to the brush handle 14.

When the radial vanes 1 of the predetermined number have been fitted to the brush handle 14 at the vane laminating position of the vane manufacturing position, the brush handle 14 is provided to the fixing device for radial vanes (FIG. 18). Specifically, the brush handle 14 is provided to the lifting chuck 30 of the fixing device. The lifting chuck 30 holds the brush handle 14 to which the radial vane 1 has been attached with the tip portion being downward, and the lifting chuck 30 is driven up and down by a cylinder 31. To the side of the cylinder 31, a welding table 32 is provided, to which a welding machine 15 is mounted. With the lifting chuck 30 being lowered, the tip face of the brush handle 14 is pressed against the welding machine 15 provided below, and the vicinity of the tip face is processed to be wider, whereby the radial vanes 1 of the predetermined number are fixed to the tip portion of the brush handle 14.

By repeating the set of steps, a 360-degree toothbrush having, at the tip portion thereof, a cylindrical brush head in which the radial vanes 1 of the predetermined number are superposed, is manufactured automatically with high efficiency.

The cylindrical brush head formed by superposing the radial vanes 1 of the predetermined number may be so configured that the inner peripheral face is made into a boss by welding so as to be formed integrally. With the configuration of inserting the boss-type integrated cylindrical brush head to the tip portion of the brush handle, a 360-degree toothbrush of a head replaceable type is configured.

If a radial vane is manufactured using a bristle member in which abrasive grain members having antibacterial action are knead, an anti-bacterial toothbrush is configured.

A boss-type integrated cylindrical brush head has an extremely high intensity. The result of a tensile test is shown in Table 1 comparing with the respective cases of a general flocked-type rolling brush and a radial vane with a boss. Although a radial vane with a boss has a sufficient high intensity, a boss-type integrated cylindrical brush head has a higher intensity.

TABLE 1

Results of Brush Tensile Test

| Name | Number of Times 1 | 2 | 3 | Ave. |
|---|---|---|---|---|
| Roll Brush | 4.81 | 2.32 | — | 3.57 |
| Disk-shaped Brush with Boss | 15.43 | 13.71 | 14.73 | 14.62 |
| Boss-type Cylindrical Brush | 20* | 20* | 20* | 20* |

Test Conditions:
Tensile Speed = about 7.5 mm/sec
Maximum Measurement Value = 20 N
1. *indicates the test piece was not sheared at 20 N.
2. The unit is indicated by Newton(N) for all.
3. The lower limit of tensile test of an implanted toothbrush is defined to be not less than 8 N in both JIS and ISO standards (For reference).

Figure 1:
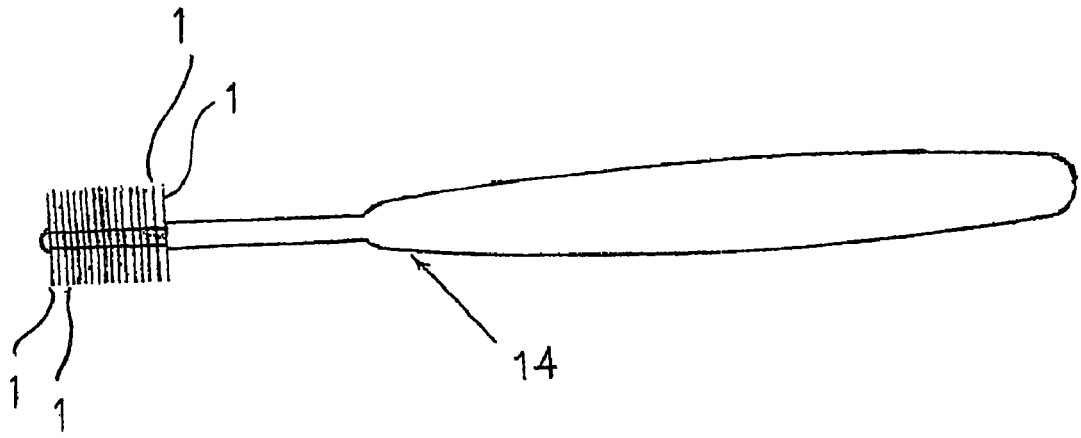
FIG. 1 is an external view of a 360-degree toothbrush showing one embodiment of the present invention.
Figure 2:
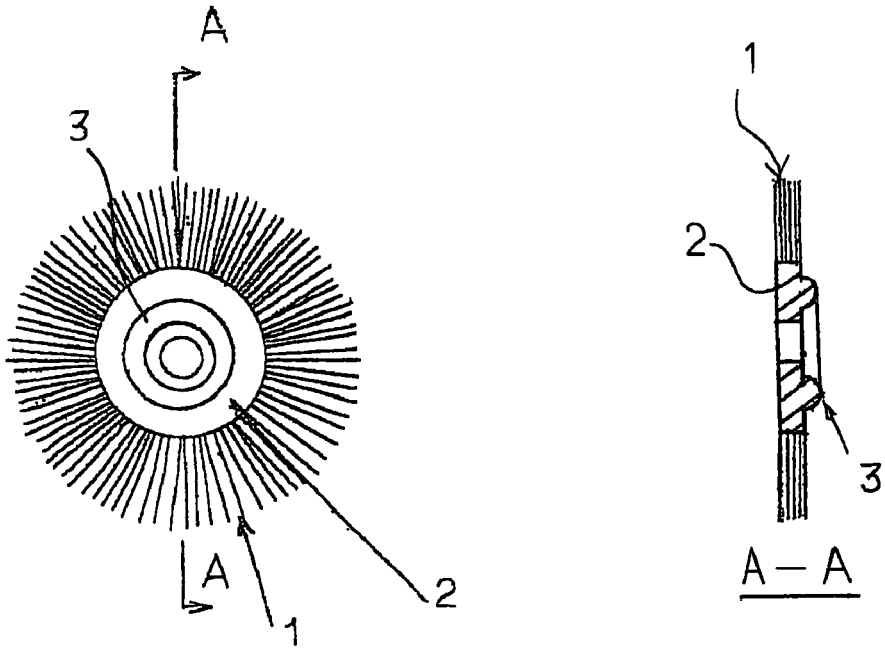
FIG. 2 is a front view of a radial vane used in the 360-degree toothbrush, and a cross-sectional view taken along the line A-A.
Figure 3:
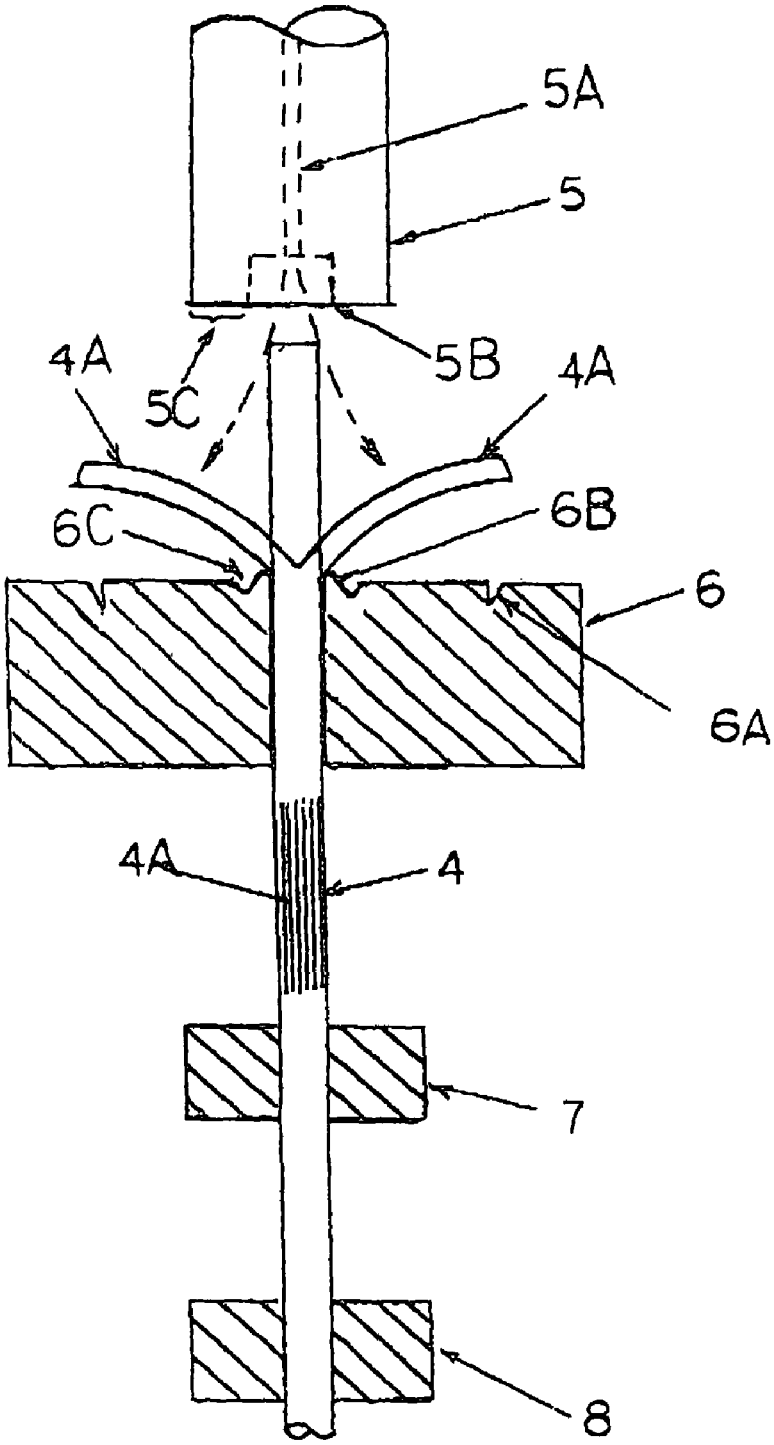
FIG. 3 is an explanatory drawing of a manufacturing method and a manufacturing apparatus for the radial vane, showing an opening step.
Figure 4:
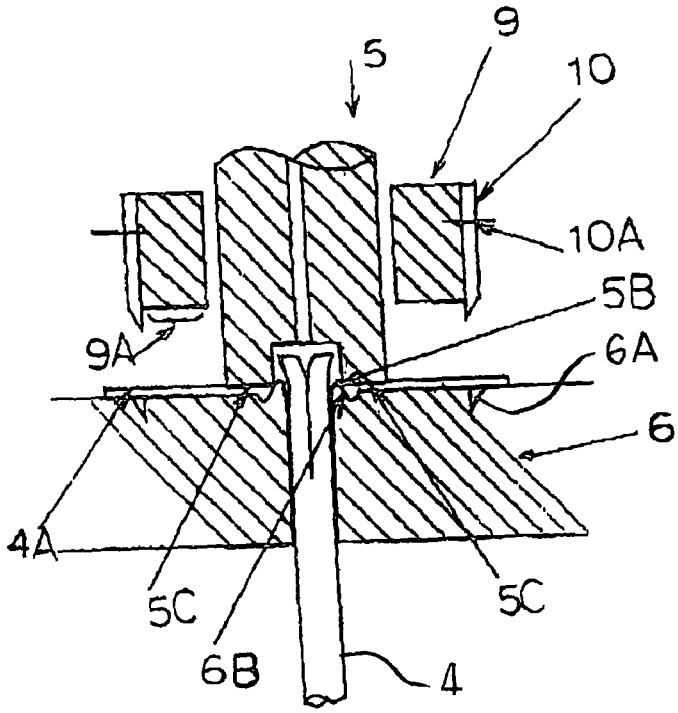
FIG. 4 is an explanatory drawing of a manufacturing method and a manufacturing apparatus for the radial vane, showing a weld removing step.
Figure 5:
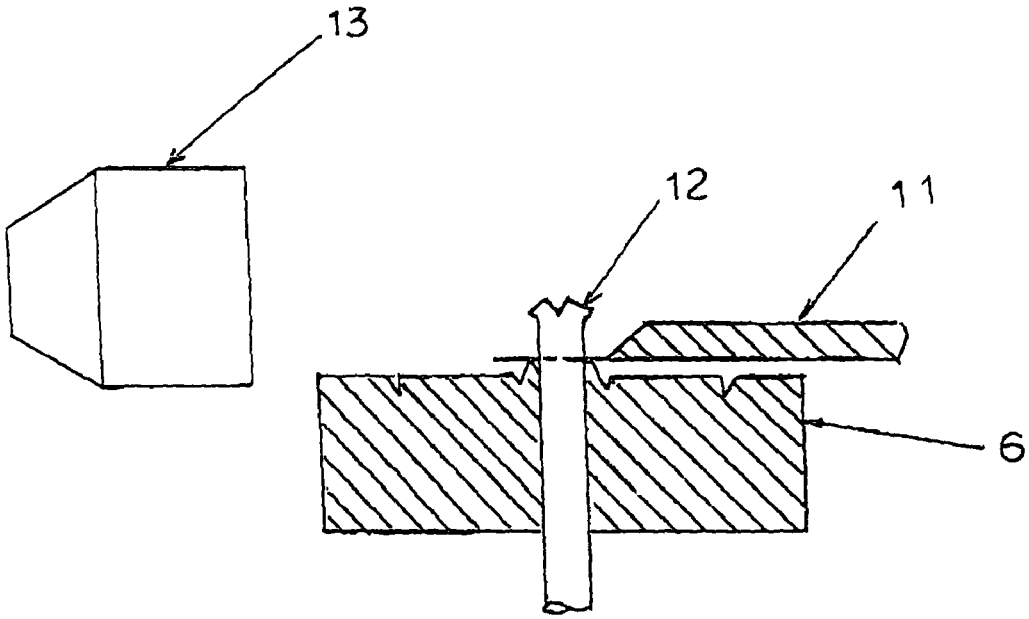
FIG. 5 is an explanatory drawing of a manufacturing method and a manufacturing apparatus for the radial vane, showing a step of removing an excess weld portion.
Figure 6:
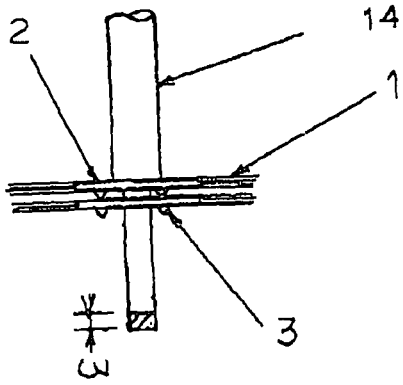
FIG. 6 is an explanatory drawing of a method of manufacturing a 360-degree toothbrush using the radial vane, showing a step of fitting the radial vane.
Figure 7:
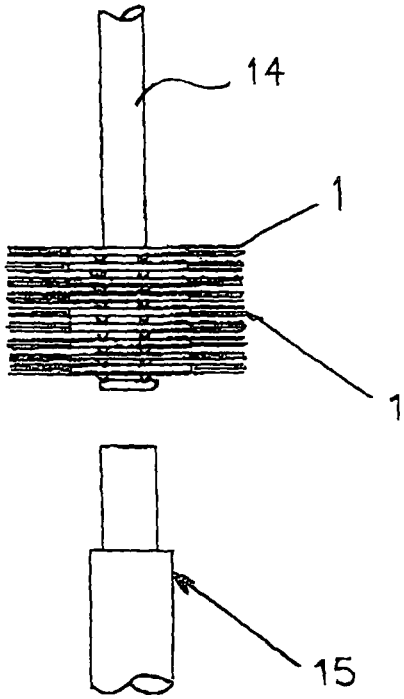
FIG. 7 is an explanatory drawing of a method of manufacturing a 360-degree toothbrush using the radial vane, showing a step of fixing the fitted radial vane.
Figure 8:
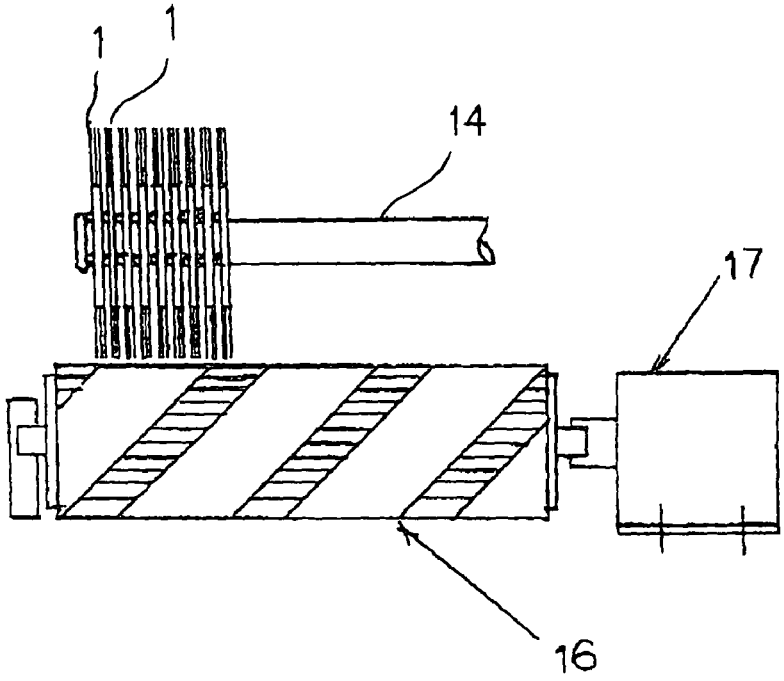
FIG. 8 is an explanatory drawing of a method of manufacturing a 360-degree toothbrush using the radial vane, showing a step of polishing the brush head.
Figure 9:
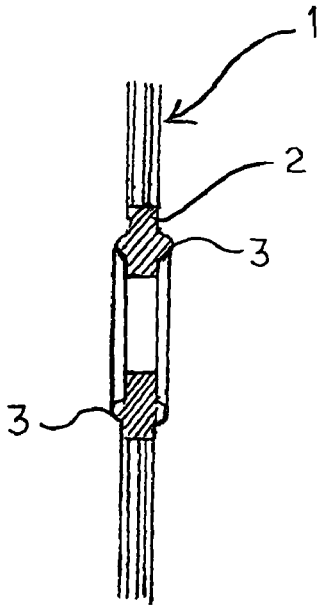
FIG. 9 is a cross-section view showing another example of a radial vane.
Figure 10:
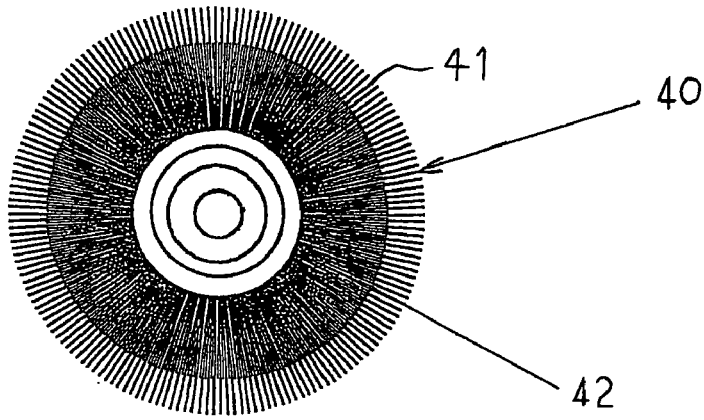
FIG. 10 is a front view showing a still another example of a radial vane.
Figure 11:
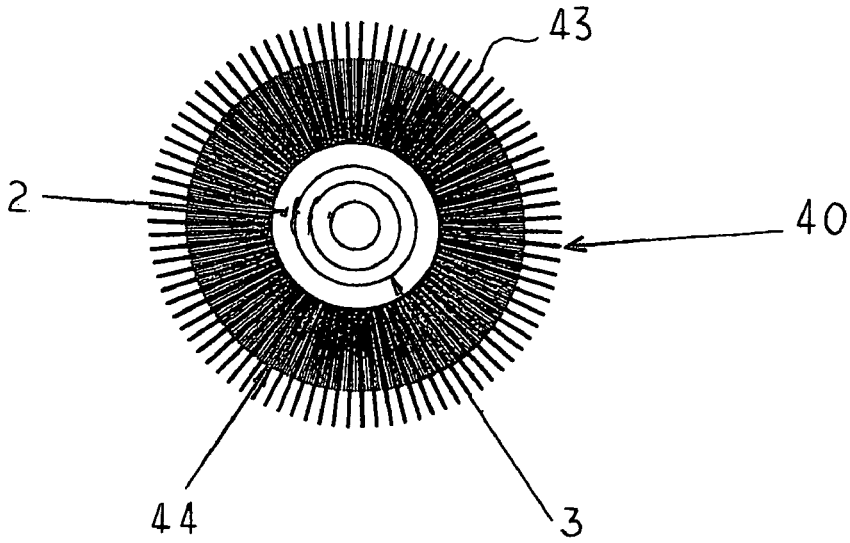
FIG. 11 is a front view showing a still another example of a radial vane.
Figure 12:
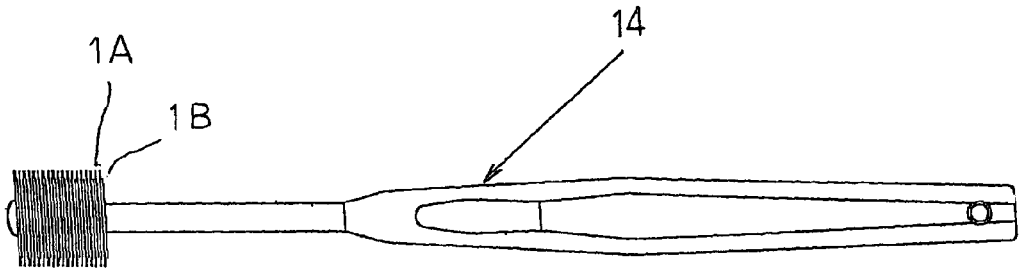
FIG. 12 is a brush external drawing showing another example of a 360-degree toothbrush.
Figure 13:
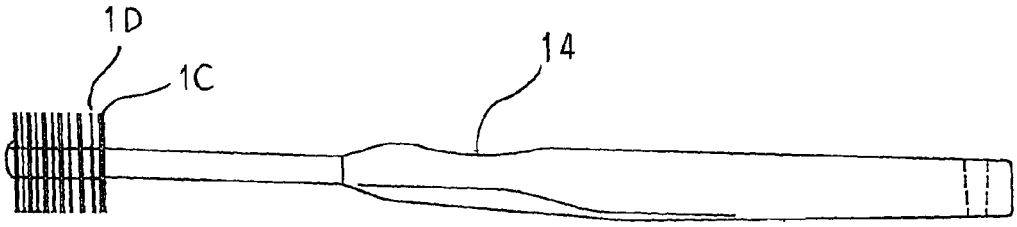
FIG. 13 is a brush external drawing showing still another example of a 360-degree toothbrush.
Figure 14:
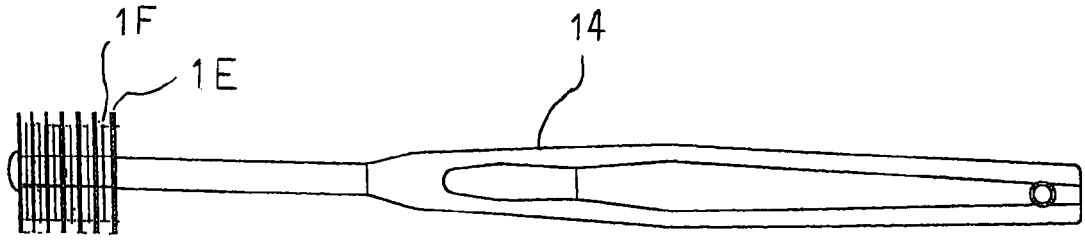
FIG. 14 is a brush external drawing showing still another example of a 360-degree toothbrush.
Figure 15:
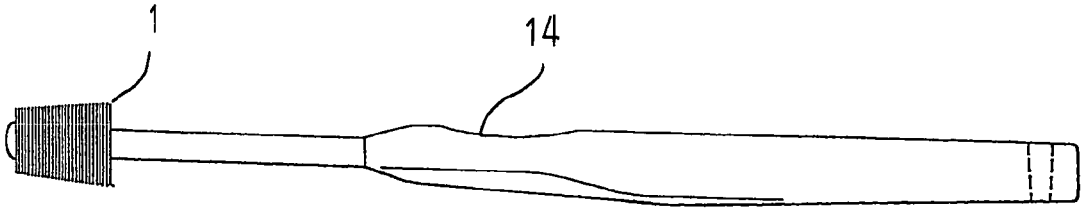
FIG. 15 is a brush external drawing showing still another example of a 360-degree toothbrush.
Figure 16:
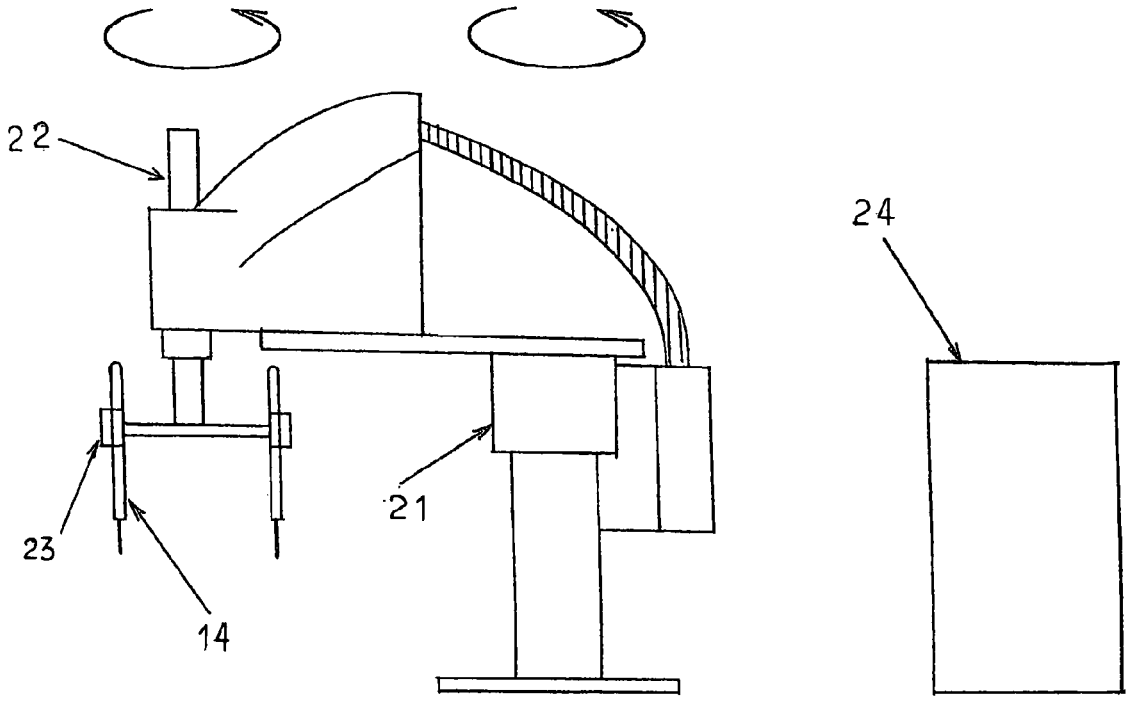
FIG. 16 is a block diagram of automatic manufacturing equipment (brush handle feeding device) of a 360-degree toothbrush.
Figure 17:
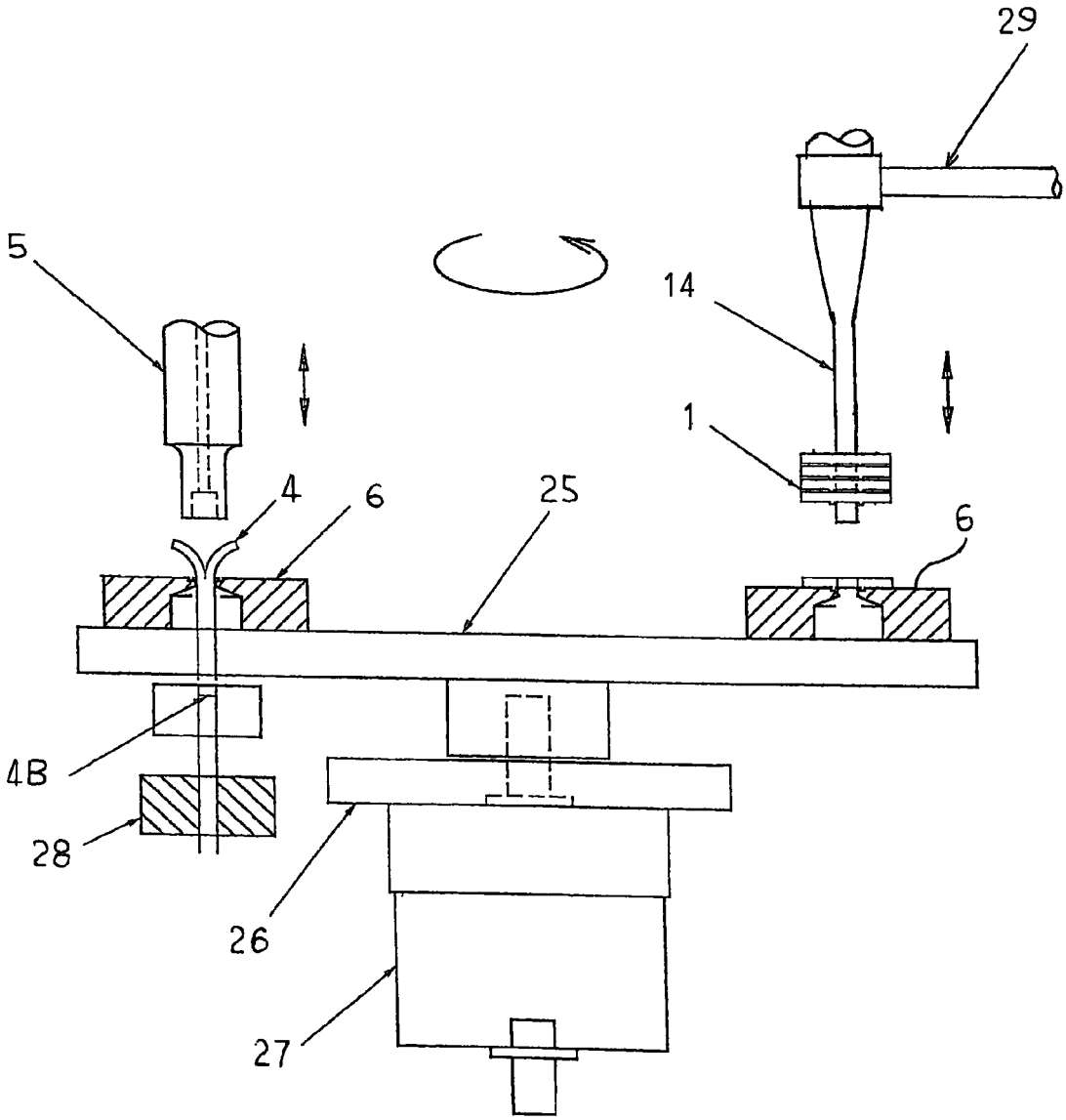
FIG. 17 is a block diagram of automatic manufacturing equipment (manufacturing and laminating device for radial vanes) of a 360-degree toothbrush.
Figure 18:
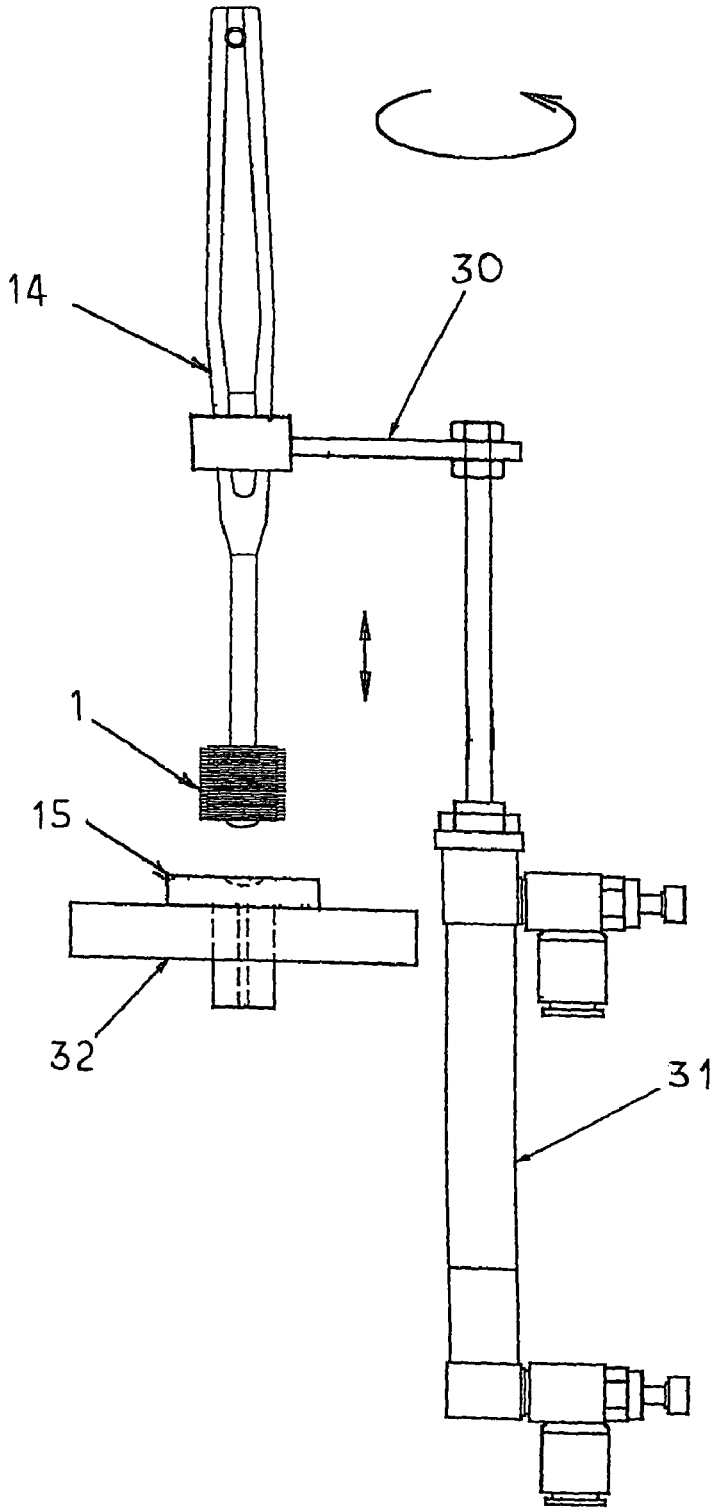
FIG. 18 is a block diagram of automatic manufacturing equipment (fixing device for radial vanes) of a 360-degree toothbrush.
Figure 19:
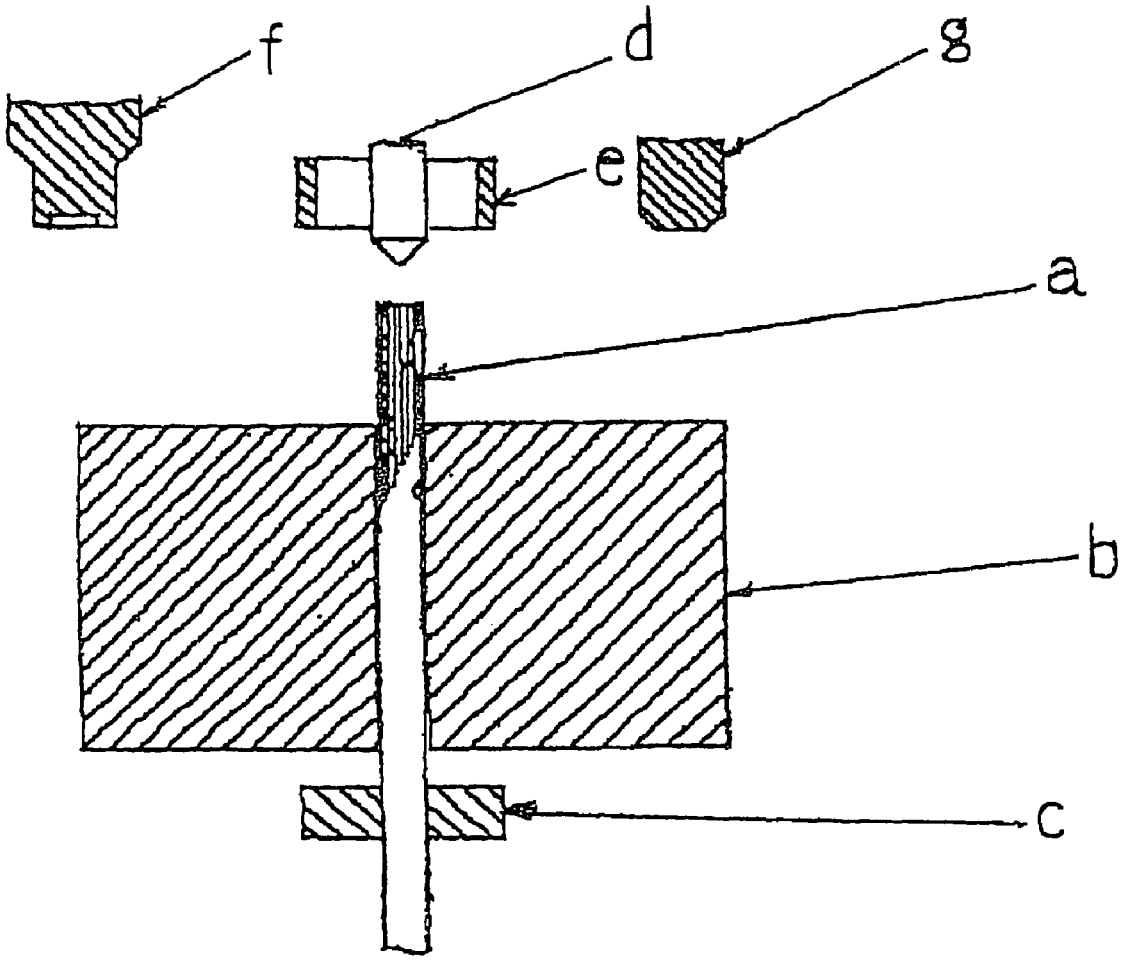
FIG. 19 is an explanatory drawing of a manufacturing apparatus for a conventional radial vane.
Figure 20:
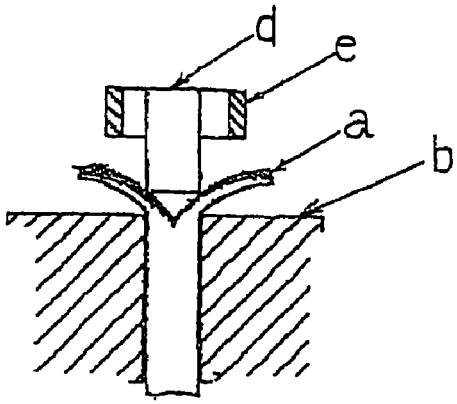
FIG. 20 is an explanatory drawing of a manufacturing method by a conventional apparatus, showing an opening step.
Figure 21:
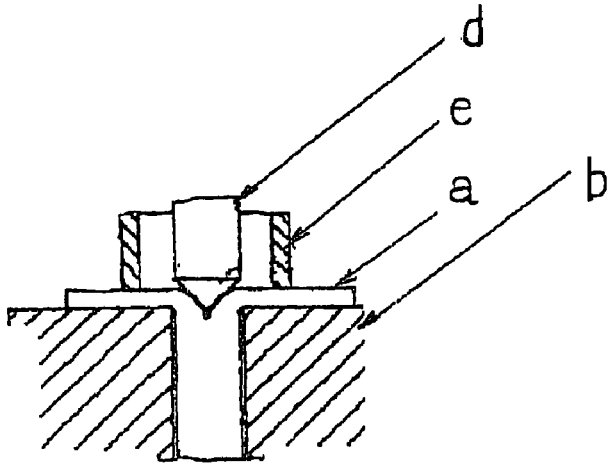
FIG. 21 is an explanatory drawing of a manufacturing method by a conventional apparatus, showing an opening step.
Figure 22:
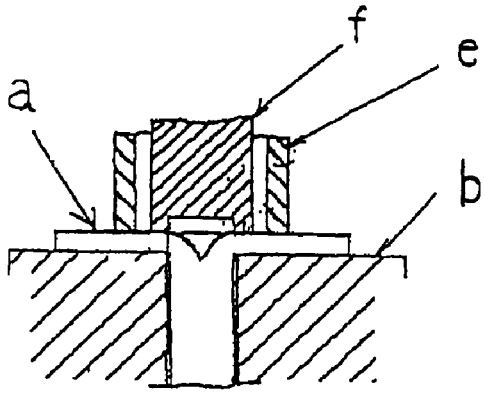
FIG. 22 is an explanatory drawing of a manufacturing method by a conventional apparatus, showing a welding step.
Figure 23:
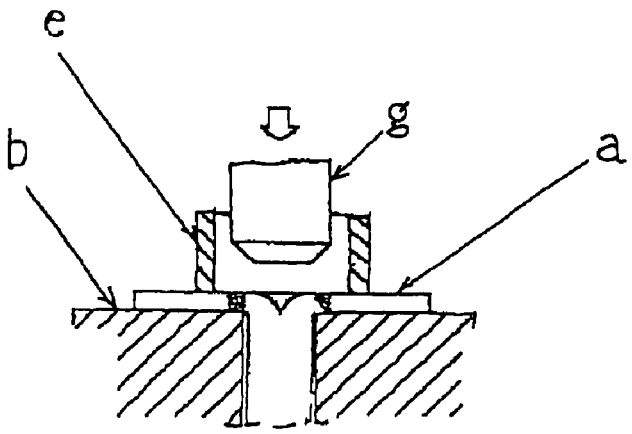
FIG. 23 is an explanatory drawing of a manufacturing method by a conventional apparatus, showing a removing step.

The invention claimed is:

1. A 360-degree toothbrush comprising:

a brush handle;

and a radial brush head in a cylindrical shape, constituted by superposing a plurality of disc shaped radial vanes arranged in the axial direction and fixed to a tip portion of the handle of the toothbrush, wherein the disc shaped radial vanes each comprises:

a disk-shape portion, a through hole formed at a center part of the disk-shaped portion, through which a tip portion of a handle of the toothbrush penetrates;

a weld portion in an annular shape provide around the through hole; and a plurality of bristle members extending outward from the weld portion in a radial direction of the disk-shape, wherein the weld portion of each of said disc shaped radial vanes includes first and second surfaces and a protrusion formed on at least one of the first and second surfaces to form clearances between the disc shaped radial vanes fixed to the tip portion of the handle of the toothbrush.

2. The 360-degree toothbrush according to claim 1, wherein the protrusion is an annular protrusion continuing in a circumferential direction.

3. The 360-degree toothbrush according to claim 1, wherein the protrusion is formed as a group of protrusions formed interspatially along a circumferential direction.

4. The 360-degree toothbrush according to claim 1, wherein the plurality of radial vanes that constitute the radial brush head include at least one hard radial vane having bristles of a large diameter and at least one soft radial vane having bristles of a small diameter mixed therein.

5. The 360-degree toothbrush according to claim 1, wherein the plurality of radial vanes that constitute the radial brush head include at least one radial vane of a large diameter having a long bristle length at a brush portion and at least one radial vane of a small diameter having a short bristle length at the brush portion mixed therein.

* * * * *